US005134836A

United States Patent [19]

Harty

[11] Patent Number: 5,134,836

[45] Date of Patent: Aug. 4, 1992

[54] NON-RUB COVER FOR SADDLE CINCH OR GIRTH

[76] Inventor: Chris Harty, Rt. 1 Box 144-A, Fredericksburg, Tex. 78624

[21] Appl. No.: 677,515

[22] Filed: Mar. 29, 1991

[51] Int. Cl.[5] ..... B68C 1/14

[52] U.S. Cl. ..... 54/23; 54/46.1

[58] Field of Search ..... 54/23, 35, 46, 58

[56] References Cited

U.S. PATENT DOCUMENTS 2,085,674 6/1937 Sidell ..... 54/23

3,805,491 4/1974 Deal ..... 54/23

FOREIGN PATENT DOCUMENTS 21462 1/1892 United Kingdom ..... 54/23

254034 7/1926 United Kingdom ..... 54/23

*Primary Examiner*—Robert P. Swiatek

*Attorney, Agent, or Firm*—Neal J. Mosely

[57] ABSTRACT

A saddle cinch or girth is a strong wide fibrous or leather band used to secure a saddle on a horse. A problem with cinches or girths is that they often wear a horse's skin raw. A non-rub cover for saddle cinches or girths is disclosed which comprises a tubular rubber sleeve which is soft and elastic and of sufficient thickness to prevent abrasive contact. The sleeve has openings on opposite sides at the middle to allow the girth rings to protrude. The sleeve is easily slid over cinch or girth and optionally the end buckles to protect against abrasion. The girth rings protruding through the openings permit the saddle straps to be fastened thereto. Another embodiment of the invention uses a protective sleeve of the same material and shape but slit longitudinally and having longitudinally extending velcro fasteners extending along the slit edges to permit the sleeve to be formed at the place of use.

6 Claims, 1 Drawing Sheet

NON-RUB COVER FOR SADDLE CINCH OR GIRTH

BACKGROUND OF THE INVENTION

1. Field of the Invention

This invention relates generally to saddle cinches or girths for securing saddles on horses and more particularly to a simple, inexpensive protective cover for cinches or girths.

2. Brief Description of the Prior Art

Saddle cinches or girths are well known in the art and consist of a strong wide fibrous or leather band used to secure a saddle on a horse. A problem with cinches or girths is that they often wear a horse's skin raw. The following patents illustrate the state of the art on this subject Littlefield U.S. Pat. No. 1,112,708 discloses a protector for harness straps which is made of thin sheet metal in the form of a flattened tube with the edges secured together by a tab and slot mechanism.

Wiesenfeld U.S. Pat. No. 1,678,373 discloses a saddle girth of composite construction having an inner elastic part and an outer sheath of leather.

Dulaney U.S. Pat. No. 3,828,521 discloses a humane elastic cinch for horses having foam rubber padding.

Land U.S. Pat. No. 4,147,015 discloses a saddle girth for horses having foam rubber padding.

Simpson U.S. Pat. No. 4,570,424 discloses a cinch for western saddles which has a non-chafing padding.

Stoner U.S. Pat. No. 3,466,852 discloses a disposable horse blanket and girth sheath. The sheath protects the straps against damage by sweat from the horse.

The present invention is distinguished over the prior art in general, and these patents in particular by a non-rub cover for saddle cinches or girths which comprises a tubular rubber sleeve which is soft and elastic and of sufficient thickness to prevent abrasive contact. The sleeve has openings on opposite sides at the middle to allow the girth rings to protrude. The sleeve is easily slid over cinch or girth and optionally the end buckles to protect against abrasion. The girth rings protruding through the openings permit the saddle straps to be fastened thereto. Another embodiment of the invention uses a protective sleeve of the same material and shape but slit longitudinally and having longitudinally extending VELCRO fasteners extending along the slit edges to permit the sleeve to be formed at the place of use.

SUMMARY OF THE INVENTION

It is therefore an object of the present invention to provide a new and improved cinch or girth for horses that is practical and humane.

It is another object of this invention is to provide a new and improved cinch or girth for horses having a non-rub cover.

Another object of this invention is to provide a new and improved cinch or girth for horses having a soft, elastic non-rub cover which is easily installed during use.

Another object of this invention is to provide a new and improved cinch or girth for horses having a non-rub cover comprising a tubular sleeve.

Still another object of this invention is to provide a new and improved cinch or girth for horses having a non-rub cover comprising a tubular sleeve provided in a split form and formed around the cinch or girth at the point of use.

Still another object of this invention is to provide a new and improved non-rub cover for cinches or girths for saddles to protect horses against abrasion.

A further object of this invention is to provide a new and improved soft, elastic non-rub cover for cinches or girths for saddles to protect horses against abrasion.

A further object of this invention is to provide a new and improved soft, elastic non-rub cover for cinches or girths for saddles which is easily installed during use to protect horses against abrasion.

Other objects of the invention will become apparent from time to time throughout the specification and claims as hereinafter related.

The above noted objects and other objects of the invention are accomplished by a novel saddle cinch or girth comprising a strong wide fibrous or leather band used to secure a saddle on a horse and having a non-rub cover which comprises a tubular rubber sleeve which is soft and elastic and of sufficient thickness to prevent abrasive contact. The sleeve has openings on opposite sides at the middle to allow the girth rings to protrude. The sleeve is easily slid over cinch or girth and optionally the end buckles to protect against abrasion. The girth rings protruding through the openings permit the saddle straps to be fastened thereto. Another embodiment of the invention uses a protective sleeve of the same material and shape but slit longitudinally and having longitudinally extending VELCRO fasteners extending along the slit edges to permit the sleeve to be formed at the place of use.

DESCRIPTION OF THE PREFERRED EMBODIMENT

Figure 1:
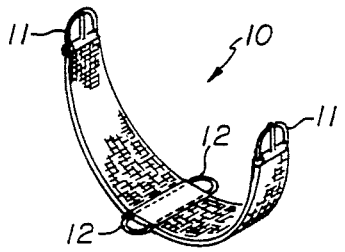
FIG.1 (PRIOR ART)
FIG. 1 is an isometric view of a conventional saddle cinch or girth formed of fibrous webbing or leather.

Referring to FIG. 1, there is shown a saddle cinch or girth 10 which is a strong wide fibrous or leather band used to secure a saddle on a horse. It partially encircles the underside of the horse near the front legs and has a pair of buckles 11 at each end and a pair of rings 12 at the middle which engage straps on the saddle. As previously noted, a problem with cinches or girths is that they often wear the horse's skin raw.

Figure 2:
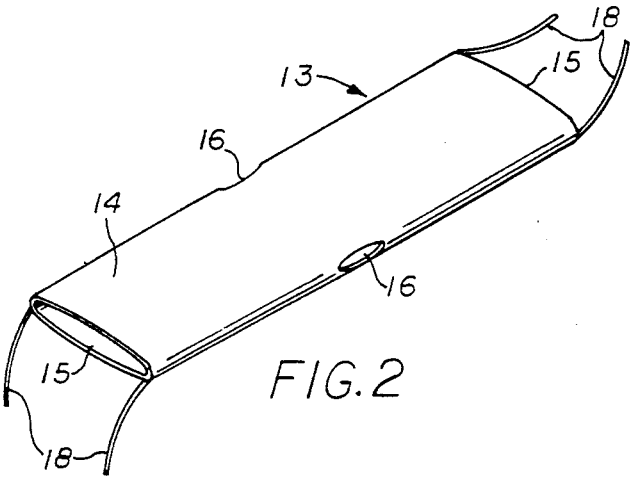
FIG. 2 is an isometric view of a new and improved soft, elastic non-rub cover for cinches or girths for saddles illustrating a preferred embodiment of this invention.

In FIG. 2, a non-rub cover 13 for saddle cinches or girths 10 is disclosed which comprises a tubular rubber sleeve 14 which is soft and elastic and of sufficient thickness to prevent abrasive contact. The sleeve has end openings 15 and openings 16 on opposite sides at the middle to allow the girth rings 12 to protrude.

Figure 3:
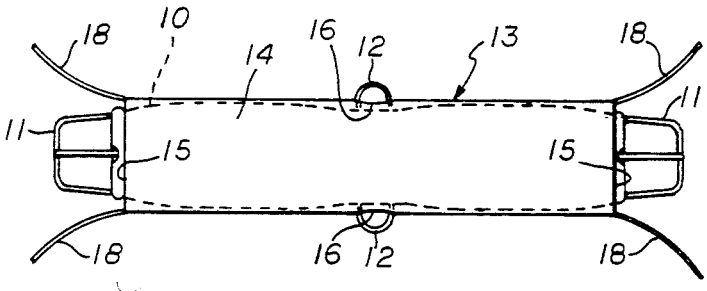
FIG. 3 is a top plan view of a new and improved soft, elastic non-rub cover installed on a cinch or girth for saddles illustrating a preferred embodiment of this invention.

As seen in FIG. 3, the sleeve 14 is easily slid over the cinch or girth 10 and optionally the end buckles to protect against abrasion. The girth rings 12 protruding through the openings 16 permit the saddle straps to be fastened thereto. The sleeve 14 is of sufficient length to cover all of the band in contact with the horse's skin. Ties or straps 18 are provided to permit the sleeve 14 to be secured to the cinch or girth ring.

Figure 4:
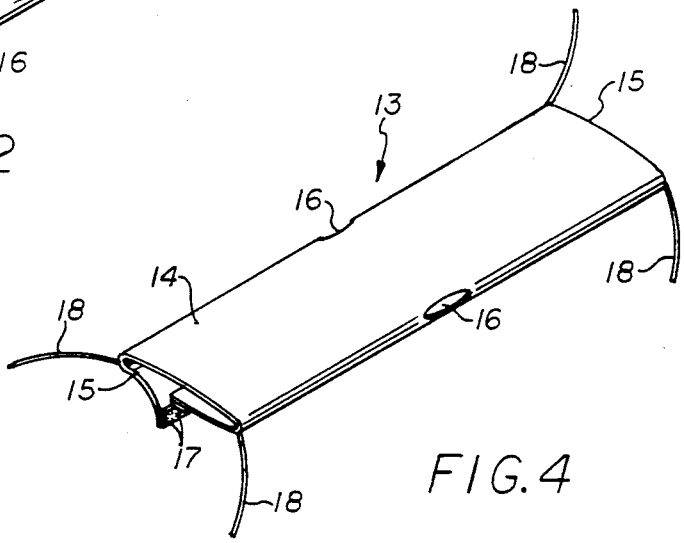
FIG. 4 is an isometric view of a new and improved soft, elastic non-rub cover for cinches or girths for saddles illustrating another embodiment of this invention.

In FIG. 4, another embodiment of the invention comprises a protective sleeve 14 of the same material and tubular shape but slit longitudinally and having longitudinally extending VELCRO fastener strips 17 extending along the slit edges to permit the sleeve to be formed at the place of use.

OPERATION

While the operation of this invention should be obvious from the foregoing description, it will be restated for clarity.

As noted above, the saddle cinch or girth 10 is a strong wide fibrous or leather band used to secure a saddle on a horse. It partially encircles the underside of the horse near the front legs and has a pair of buckles 11 at each end and a pair of rings 12 at the middle which engage straps on the saddle. The non-rub cover 13 is installed over an existing saddle cinch or girth 10 as a tubular rubber sleeve 14 which is soft and elastic and of sufficient thickness to prevent abrasive contact. The end openings 15 permit the sleeve to be slid over the cinch or girth until centered with the end buckles 11 extending outside the sleeve and the openings 16 allowing the girth rings 12 to protrude as seen in FIG. 3 to permit the saddle straps to be fastened thereto. Ties or straps 18 are provided to permit the sleeve 14 to be secured to the cinch or girth ring. The softness and elasticity of the rubber sleeve prevent abrasive contact to the skin of the horse. The sleeve 14 is of sufficient length to cover all of the band in contact with the horse's skin and optionally the end buckles. The rubber sleeve is superior to other materials in that it tends to stick to the skin of the horse and allow the cinch or girth to rub on the sleeve rather than on the horse's skin.

The embodiment of FIG. 4 is used in the same manner as that of FIGS. 1-3 except that the longitudinal slit allows the sleeve to be formed at the point of use and secured by the longitudinally extending VELCRO fastener strips 17. As in the embodiment of FIGS. 1-3, the softness and elasticity of the rubber sleeve prevent abrasive contact to the skin of the horse.

While this invention has been shown fully and completely with special emphasis on certain preferred embodiments, it should be understood that within the scope of the appended claims the invention may be practiced otherwise than as specifically described herein.

I claim:

1. A cinch or girth assembly comprising a fibrous or leather band having buckles for connection to saddle straps at opposite ends and girth or cinch rings on opposite sides at the middle thereof, a non-rub cover for said band comprising a tubular sleeve having opposite end edges and which is soft and elastic and of sufficient thickness to prevent abrasive contact, which cover is open along both end edges to permit assembly by sliding over said fibrous or leather band, said buckles extending outward at opposite ends of said sleeve, and said sleeve having openings at the middle on opposite sides through which said girth or cinch rings protrude, being of sufficient elasticity and thickness to prevent abrasive contact to the skin of a horse on which the assembly is used, and of sufficient length to cover all of the band.

2. A cinch or girth assembly according to claim 1 in which said sleeve is slot longitudinally and has VELCRO fasteners extending longitudinally along the slit edges to secure the sleeve together in use.

3. A cinch or girth assembly according to claim 1 including tie straps permitting said sleeve to be secured to said cinch or girdle.

4. A soft non-rub cover for use with a fibrous or leather webbing having buckles for connection to saddle straps at opposite ends and girth or cinch rings on opposite sides at the middle thereof, said non-rub cover comprising a tubular rubber sleeve having opposite end edges and which is soft and elastic and of sufficient thickness to prevent abrasive contact, which cover is open along both end edges to permit assembly by sliding over said fibrous or leather webbing, said buckles extending outward at opposite ends of said sleeve when installed, and said sleeve having openings at the middle on opposite sides through which said girth or cinch rings protrude when installed, being of sufficient elasticity and thickness to prevent abrasive contact to the skin of a horse on which the assembly is used, and of sufficient length to cover all of the webbing.

5. A soft non-rub cover for a cinch or girth assembly according to claim 4 in which said sleeve is slit longitudinally and has VELCRO fasteners extending longitudinally along the slit edges to secure the sleeve together in use.

6. A soft non-rub cover for a cinch or girth assembly according to claim 4 including tie straps permitting said sleeve to be secured to said cinch or girdle.

* * * * *